United States Patent [19]

Stiekel et al.

[11] Patent Number: 4,528,540

[45] Date of Patent: Jul. 9, 1985

[54] THERMOSTAT

[75] Inventors: Jan J. Stiekel, Coevorden; Marinus Hagen, Enschede; Klaas H. Prins, Nijverdal; Philips M. Gerson, Velp, all of Netherlands

[73] Assignee: Texas Instruments Incorporated, Dallas, Tex.

[21] Appl. No.: 609,948

[22] Filed: May 14, 1984

[30] Foreign Application Priority Data

Jun. 20, 1983 [EP] European Pat. Off. ..... 832000914.6

[51] Int. Cl.[3] ..... H01H 61/02; H01H 37/04

[52] U.S. Cl. ..... 337/102; 337/89; 337/91; 337/367; 337/380

[58] Field of Search ..... 337/365, 367, 380, 375, 337/362, 343, 368, 374, 89, 91, 94, 56, 112, 348, 349, 358, 37, 53, 102

[56] References Cited

U.S. PATENT DOCUMENTS

| | | | |
|---|---|---|---|
| 1,875,699 | 9/1932 | Brady | 337/362 |
| 2,627,003 | 1/1953 | Porter | 337/374 |
| 2,851,559 | 9/1958 | Rosen | 337/375 |
| 4,399,423 | 8/1983 | Nield | 337/102 |

*Primary Examiner*—Harold Broome

*Attorney, Agent, or Firm*—James P. McAndrews; John A. Haug; Melvin Sharp

[57] ABSTRACT

A thermostat comprising a bimetal switch element reacting at selected temperatures which on one of its ends is fastened on a frame and on the other end is provided with an electric contact adapted to engage a fixed contact provided on the frame, said frame comprising two mutually parallel sheet-like metallic contact carriers forming a base unit, through which two parallel ceramic pins are extending for insulating connection of the two contact carriers and on which pins the contact carriers, with a tight fit, are slidable to and fro relative to one another and are maintained permanently mutually parallel during such mounting, each of said contact carriers having an aperture for lateral exposing of nearly the complete bimetal switch element.

18 Claims, 13 Drawing Figures

FIG.5
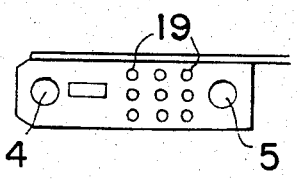
FIG.6
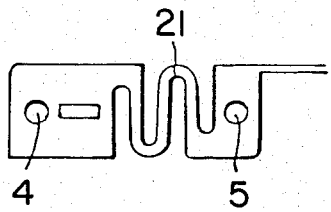
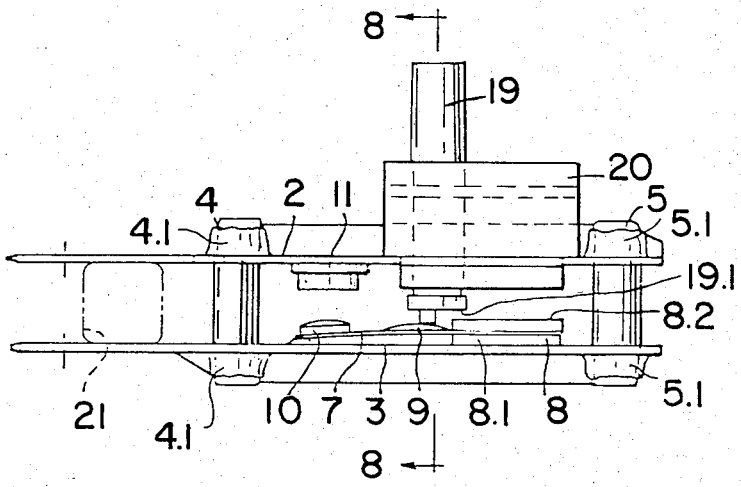
FIG.7
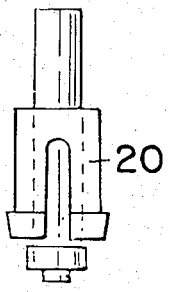
FIG.8

THERMOSTAT

BACKGROUND OF THE INVENTION

The present invention relates to a thermostat comprising a bimetal switch element reacting at selected temperatures which on one of its ends is fastened on a frame and on its other end is provided with an electric contact adapted to engage a fixed contact provided on the frame.

As thus described, such a thermostat is generally known.

Usually in thermostats a bimetal switch element is used as a temperature sensing member. This switch element is moveable in dependence on the ambient temperature either with continuous creep movement or with snap-action. The bimetal itself can conduct a current in the electric circuit. In dependence on the self-heating of the switch element by such current, the thermostat can also be current responsive. Said current sensibility can be increased by applying additional heating means on the thermostat. The switching time is highly influenced by the heat mass and heat transfer in the thermostat and, of course, also by the temperature at which the switch element will open or close the electric circuit in which the thermostat is incorporated.

Since it is easier to add mass to the thermostat than remove mass both for the fixed thermostat function and the current sensing function, a light mass is usually desirable. However, the risk of permanent deformations during manufacture, adjustment and use of the thermostat is increased thereby.

Frequently upon manufacture of said thermostat, differences in materials and dimesions will cause an inaccurate circuit response, said inaccuracies being difficult to correct. The larger the number of parts of the thermostat, the harder said correction will be.

Usually for this kind of thermostat a large number of model types is also required. Such models differ not only with respect to the desired switch operating temperature and with respect to the various sensibilities to temperature and current of the bimetal and the overall thermostat, but also with respect to the mechanical differences in the connecting terminals in the electric circuit.

This makes an accurate structure more difficult too.

SUMMARY OF THE INVENTION

The present invention comprises a thermostat as described above, giving an appropriate solution to the abovementioned problems, whereby a great accuracy, even at high ambient temperatures, is obtained and simple, versatile manufacture in large volume is enabled.

The invention is characterized in that the frame comprised two mutually parallel sheet-like metal contact carriers forming a base unit through which two parallel ceramic pins are extending for insulating connection of both contact carriers and on which pins the contact carriers, with a tight fit, are slidable to and fro relative to one another and are maintained permanently mutually parallel during such mounting, each of said contact carriers preferably having an aperture for lateral exposing of nearly the complete bimetal switch element.

Since the switch element is the only moving part and has to provide the right temperature sensing after adjustment, this switch element is positioned between both metal contact carriers whereby a good protective mechanical screening of the bimetal environment is guaranteed. Owing to the lack of plastics in the base unit, a high ambient temperature is admissible. Since the terminals connecting the thermostat in the electric circuit will be arranged so they have relatively little mechanical effect on the operation of the thermostat, they can be chosen freely as to their shape, e.g. as a quick connect terminal, or a welded, screwed, riveted or swaged connecting terminal, or an inserting pin for sheets with printed circuits, etc.

The thermostat can be made more responsive to current by the choice of the bimetal material and by manufacturing one or both contact carriers from a selected resistance material. The resistance sensibility of the contact carriers can be modified by the resistivity of the material itself, by the choice of the material thickness, and by the section and length of the path of current in the contact carriers. Owing thereto no additional heating means for the thermostat are required, there is a direct heat conduction from the contact carriers to the switch element, and the mass of the thermostat is slight which results in short times for switching on and off.

The thermostat can also be made further sensible to current by using an additional heating means. This means is positioned against the thermostat then and is spaced and supported by the ends of said ceramic pins.

In this way a good electric insulation between the heating means and thermostat is obtained and also a fixed distance between the heating means and switch element is guaranteed. By additionally applying a heat sink or well, e.g. a ceramic bar with current wire winding in a housing or a U-shaped gutter with a current-carrying wire winding, the switch behaviour can be further influenced. The heat excited by the heating means is partly stored in the heat well. After switching off of the thermostat this heat is liberated and in this way it keeps the contacts open for a long time. Since the heating means is supported along its full length this means can be subjected to a maximum current load without risk of sagging or bagging out. For the heating means very thin material may be used, whereby a very current-responsive thermostat is created. On account of the cooling effect of the heat well on the heating means the latter will be less likely to burn through quickly so that the thermostat will be more able to stand peak loads.

Furthermore the thermostat may be provided with a bimetal switch element such that it can only be reset to its normal position manually when the ambient temperature has returned to a determine value.

It is preferred that a push button is arranged for accomplishing resetting by pushing on the convex side of a dished portion of the bimetal switch element so that with proper dimensioning of the parts, operation of the pushbutton creates an always-safe, open contacts situation and only upon again releasing the reset button will the desired switching operation of the switch element be restored. In that way, the safety function of the thermostat cannot be circumvented by continued operation of the reset button.

The present thermostat is operable at high temperatures, has a very narrow temperature tolerance during switching on and off, and has a very wide timing range. Further the forces exerted on the ceramic pins are divided very equably, which reduces the risk of breakage to a minimum.

The thermostat is versatile in that a large number of configurations of the connecting terminals on the contact carriers and the application of adjusting buttons, heating means, cases and housings is possible, while the base unit of the thermostat remains unmodified thereby.

The thermally responsive device of this invention is adapted to be applied as a thermostat or protector in hair dryers, car wind screen wiper motors, refrigerator compressor motors, panels with printed circuits, light starters, fan heaters, toy transformers, etc.

In this way of mounting and adjusting, it is also guaranteed that the mutual sheets and position of the contacts can be accurately maintained upon manufacture, so that the optimum shaping with respect to the switch behaviour (mechanical wear, formation of sparks and the like) can also be realised upon the intended wholesale manufacture.

Finally, additional modifications are possible in dependance on the embodiment and position of the connecting terminals and a selected timing can be obtained by positioning a direct heat capacity means, e.g. ceramic material, a coating or a fastened metal onto the contact carriers. Also a heating element, preferably with PTC-characteristic, can be positioned between the connecting terminals. This heating element, which is connected in electrically parallel relation to the switch element, is put into operation upon opening of the contacts and keeps the contacts open through the heat then generated. Only by switching off the main current is the thermostat brought to resetting. Of course combinations of the abovementioned measures are possible.

DESCRIPTION OF THE DRAWINGS

The invention will be further elucidated now from the drawing.

FIG. 5 shows a partial plan view of an embodiment of one of the contact carriers in which a terminal end portion of the carrier is provided with perforations.

FIG. 6 shows a partial plan view of an embodiment of one of the contact carriers in which a terminal end portion of the carrier is provided with zigzag-like path of current between its ends.

FIG. 7 shows an embodiment of the invention having a push button structure for resetting the switch element to its normal position.

FIG. 8 is a partial section view along line 8—8 of FIG. 7.

DESCRIPTION OF THE PREFERRED EMBODIMENTS

Figure 1:
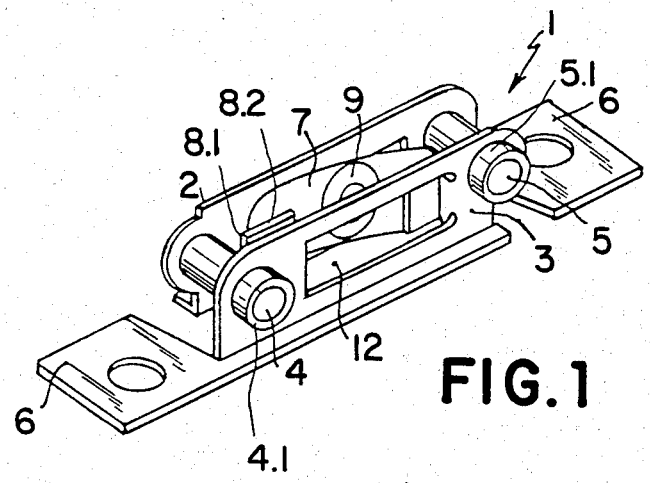
FIG. 1 shows a perspective view of a base unit according to the invention.

The base unit 1 in FIG. 1 comprises two mutually parallel, sheet-like metal contact carriers 2 and 3 of steel or the like which, with a tight fit, are fastened on two parallel, dimensionally stable, ceramic pins 4 and 5 electrically insulating the contact carriers from each other. The pins extend through two deep-drawn holes in the contact carriers. The contact carriers are press-fitted on and are slidable to and fro on the ceramic pins to be disposed in selected location relative to one another and are maintained mutually parallel during such assembly and adjustment of the thermostat unit. That is, each carrier has two holes surrounded by integral flanges 4.1, 5.1 which are deep-drawn from the carrier material and the ceramic pins are press-fitted into those holes to frictionally engage the deep-drawn flanges to hold the carriers parallel to each other as they are moved into a selected spaced relation to each other on the pins. The contact carriers also comprise connecting terminals 6, 6 which in base unit 1 are provided on opposite ends of the base unit and are aligned with one another to extend in opposite longitudinal directions from the base unit (FIG. 1).

On the inner side of one of the contact carriers 3 a thermostat metal switch element 7 is fastened at 8 on the relevant contact carrier by e.g. welding. Preferably for example the carrier is embossed at 8.1 and an end of the thermostat metal element has a weld slug 8.2 welded on one side. That end of the element is welded to the carrier embossment 8.1. The switch element preferably comprises a bimetal having an indenture or dished portion 9 which moves to an inverted dished configuration with a snap-action when the bimetal is heated to a predetermined temperature. In some embodiments of the element 7, the indenture 9 returns to its original configuration with snap action when the element cools to a reset temperature and in some embodiments that reset temperature is selected to be very low so the element requires resetting by hand to its normal position when the ambient temperature has a determined value such as normal room temperature. The dished portion 9 is circular in the shown embodiment. However it may have another shape too.

The switch element comprises on its movable end a contact 10 adapted to engage a fixed contact 11 fastened on the inner side of the other contact carrier. The contact 10 is resiliently biased into a closed circuit position engaging the fixed contact 11 by the thermostat metal element 7 when the element indenture 9 has one configuration as shown in FIG. 1 and is in an open circuit position disengaged from the contact 11 when the indenture has its opposite configuration. (See FIG. 7). Each contact carrier preferably has an aperture 12 (FIG. 1) for the lateral exposing of nearly the complete bimetal switch element 7 to be more rapidly responsive to changes in ambient temperature. Furthermore each contact carrier may be manufactured from a resistance material, whereby the current sensibility of the thermostat is increased. The contact carriers may be manufactured from the same material or from two different materials. A contact may comprise three layers, e.g. from Ni-Cu-Ag (CdO). It is also possible that the switch element has not been provided with an indenture and moves with creep action.

Each contact carrier may also comprise an end portion having a number of perforations 19 (vide FIG. 5), or a serpentine zigzag-like path of current (21) (FIG. 6) of reduced cross section. These measures are applied for varying the resistance and the heat generating and holding capacity of a contact carrier in order to obtain therewith a modification of the switching times of the thermostat.

In that arrangement, the contact carriers 2,3 are slidable relative to each other on the ceramic pins 4,5. The pins remain parallel to each other during such sliding movement and the carriers are also maintained parallel to each other as they are moved on the pins. The thermostat element 7 is adjusted in position relative to the fixed contact 11 by that means and, with an element 7 of selected characteristics, the thermostat 1 is thereby calibrated so that the element 7 moves between open and closed circuit positions at precisely predetermined temperatures. The ceramic pins 4,5 are press-fitted into the noted carrier holes and there is substantial frictional engagement between the ceramic surfaces of the pins and the flanged portions 4.1, 5.1 of the carriers so that the carriers are thereby secured in desired spaced relation to each other.

The connecting terminals may have various shapes and positions. For instance the connecting terminals 6*a* in unit 1*a* of FIG. 1A may be provided on the outer sides of the contact carriers and extend in opposite directions.

Figure 1A:
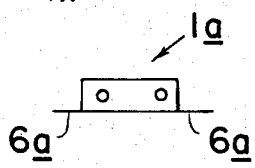
FIGS. 1A–1E show alternate embodiments of connecting terminals on the base unit of FIG. 1.
Figure 1B:
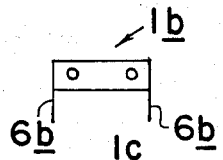

In the FIG. 1B the connecting terminals 6*b* are provided on the ends of the base unit 1*b* and extend in the same direction perpendicularly to the longitudinal direction of the base unit.

Figure 1C:
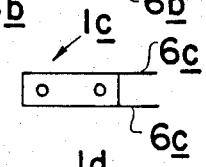
Figure 1D:
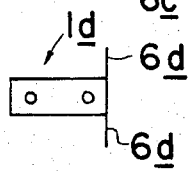

In FIG. 1C the connecting terminals 6*c* extend longitudinally to the base unit 1*c* from one end of the base unit, said terminals being parallel and extending in the same direction.

In FIG, 1D the connecting terminals 6*d* extend perpendicularly to the longitudinal direction of the base unit 1*d*. They are provided on one end of the base unit, are aligned to one another and are directed oppositely.

Figure 1E:
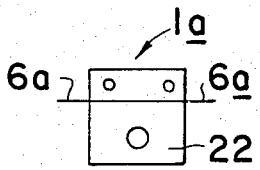

In FIG. 1E the base unit 1*a* of FIG. 1A is used in an assembly in which an electrically insulating fastening means 22 is added.

Figure 2:
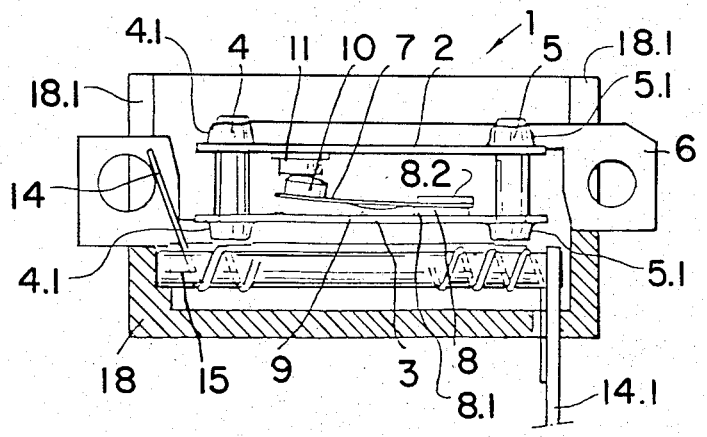
FIG. 2 shows a plan view of a base unit according to the invention with an embodiment of a heating means shown partially in longitudinal section fastened thereon.
Figure 3:
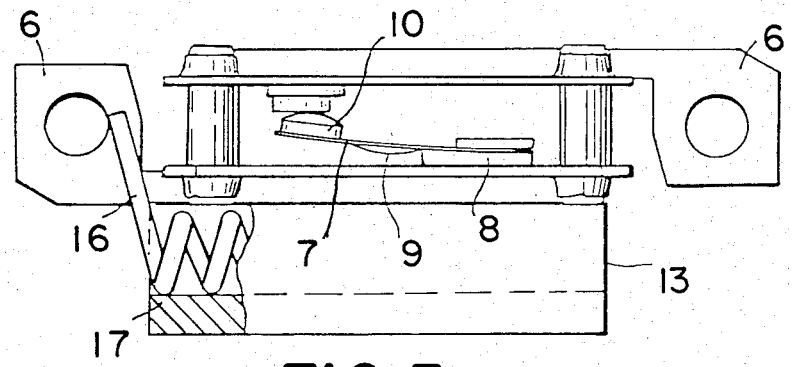
FIG. 3 shows a plan view of a base unit according to the invention and a partial section view of another type of heating means for the base unit diagrammatically illustrating use of the heating means with the base unit.
Figure 4:
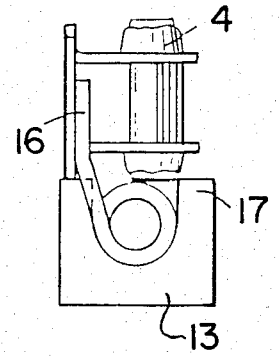
FIG. 4 shows an end view of the heating means of FIG. 3.

In FIGS. 2 and 3 the base unit is fitted out with a heating means which is attached thereon in any conventional way. This heating means can be carried out as a winding 14 about a ceramic heat sink bar 15 both provided in an insulating housing 18. The bar 15 is engaged or supported by corresponsing ends of the ceramic pins 4, 5 for spacing the heating means from the element 7 while assuring desired electrical spacing of the heating means from the carriers 2,3. The ends of the winding 14 are secured to a carrier terminal 6 and to a heater terminal 14.1 by soldering or the like if desired. The housing 18 is secured to the base unit 1 by fitting of the terminals 6 into slots 18.1 in the housing or in any other conventional manner. In the FIGS. 3 and 4 a modified heating means 13 is applied. It only consists of a current wire winding 16 provided in a ceramic gutter 17 as is diagram-matically illustrated in FIG. 4. The gutter is attached to the base unit 1 in any conventional manner (not shown).

FIGS. 7 and 8 show an embodiment of a push button structure for manually resetting the switch element to its normal position. In that embodiment, the thermostat metal element 7 is selected to have an operating temperature at which the indenture 9 moves from its original dished configuration to an inverted dished configuration with snap action so the element moves the contact 10 sharply to an open contacts control position as shown in FIG. 7 and to have a reset temperature below room temperature or the like so its indenture 9 does not normally return to its original dished configuration after the element 7 has once moved to open the the device circuit. The push button 19 is then preferably arranged so that when it is pressed it will engage the indenture 9 on the side of the indenture which is then convex. The push button is mounted in a housing 20 fastened on the carrier 2. Preferably the housing is secured to the carrier by being pressed into the aperture 12 in the carrier. Manual movement of the push button against the convex side of the indenture 9 then serves to snap the indenture back to its original dished configuration for permitting subsequent snap acting movement of the element 7 back to closed circuit position when the push button is thereafter released. Preferably the push button is dimensioned and the element 7 is arranged as shown in FIG. 7 so that movement of the element by pressing of the push button holds the contact 10 safely in its open contacts position while the push button is retained manually depressed. In that way the safety function of the thermostat 1 in opening a circuit is not circumvented by holding the push button down. The element 7 is permitted to return to closed circuit position only when a pushbutton is manually released as noted above. Of course, if the element has not cooled below its operating temperature when the pushbutton is released, the element promptly moves to maintain its opened contact position. Preferably the pushbutton 19 is proportioned and located as indicated in FIG. 7 so that a portion 19.1 of the pushbutton is adapted to engage a stop such as a portion of the weld slug 8.2. In that way, when the pushbutton is manually depressed for resetting the thermostat. The engagement of that pushbutton portion limits the pushbutton movement and protects the element 7 from excessive pushbutton force which might damage the thermal response characteristics of the element.

If desired, a ceramic heater element of a material of positive temperature coefficient (PTC) of resistivity is electrically connected between the carrier terminals 6 in electrically parallel relation to the element 7 as indicated 21 in FIG. 7. In that arrangement, the heater is energized on separation of the contacts 10 and 11 and is proportioned for heating the element 7 to prevent resetting of the thermostat 1 until the thermostat is disconnected from the noted electrical circuit. The PTC characteristic of that heater renders the heater self-regulating to stabilize at a safe temperature.

It should be understood that this invention includes modifications of the above-disclosed embodiments of the invention falling within the scope of the appended claims.

We claim:

1. A thermostat comprising a bimetal switch element reacting upon temperatures which on one of its ends is fastened on a frame and on another end is provided with an electric contact adapted to engage a fixed contact provided on the frame, characterized in that the frame comprises two mutually parallel sheet-like metallic contact carriers forming a base unit, through which two parallel ceramic pins are extending for insulating connection of both contact carriers and on which pins the contact carriers, with a tight fit, are slidable to and fro relative to one another and are maintained in permanent mutually parallel relation to each other during such slidable mounting movement.

2. A thermostat according to claim 1 wherein each carrier has an aperture for lateral exposing of nearly the complete bimetal switch element.

3. A thermostat according to claim 1 characterized in that each contact carrier has two holes for receiving the ceramic pins and has deep-drawn portions of the carriers forming flange portions around the respective holes to assure holding of the carriers in parallel relation to each other.

4. A thermostat according to claim 1 characterized in that the switch element on the said fastening end on said contact carrier is fastened on an inner side of the carrier in facing relation to the other carrier.

5. A thermally responsive device comprising a frame a fixed contact on the frame, and a thermostat metal element having one end fastened to the frame and having an opposite end moveable between control positions of engagement and disengagement with respect to the fixed contact in response to temperature change, characterized in that the frame comprises two parallel metal carriers respectively mounting the fixed contact and the thermostat metal element, each carrier having a pair of holes therein, and a pair electrically insulated pins extending in parallel relation to each other through holes in the respective carriers, the pins being slideable with a tight fit in said holes for securing the carriers in selected spaced relation to each other on the pins so that the thermostat metal element moves to one of said control positions in response to the occurrence of a selected element temperature.

6. A thermally responsive device according to claim 5 having integral flange portions of the carriers deep-drawn around said holes engaging the pins to assure that the pins are secured in parallel relation to each other on the pins.

7. A thermally responsive device according to claim 6 having the thermostat metal element mounted on a side of one of the carriers which is disposed in facing relation to the other carrier for shielding the thermostat metal element between the carriers during handling of the thermally responsive device.

8. A thermally responsive device according to claim 7 wherein the carriers have apertures therein for facilitating exposing of opposite sides of the thermostat metal element to ambient temperatures.

9. A thermally responsive device according to claim 5 wherein pins are formed of a dimensionally stable ceramic material press-fitted into frictional engagement with said carrier flange portions.

10. A thermally responsive device according to claim 5 further characterized in that said metal carriers each comprise a sheet-like member having an end portion adapted to serve as a terminal for connecting tne carrier in an electrical circuit, said end portion being of selected reduced cross section for regulating the heat generating capacity of the carrier end portion.

11. A thermally responsive device according to claim 10 wherein said reduced cross section is formed by perforations in said end portion of the carrier.

12. A thermally responsive device according to claim 10 wherein said reduced cross section is of a serpentine configuration.

13. A thermally responsive device according to claim 5 having electrical heating means secured thereto for regulating thermal response characteristics of the device, said heating means being disposed in engagement with respective ends of said electrically insulating pins to be disposed in selected spaced relating to said thermostat metal element.

14. A thermally responsive device according to claim 13 wherein said heating means comprises a wire heating coil wound on a ceramic heat well member.

15. A thermally responsive device according to claim 13 wherein said heating means comprises a wire heating coil supported in a ceramic gutter heat well member.

16. A thermally responsive device comprising a frame, a fixed contact mounted on the frame, and a thermostat metal element having one end fastened to the frame and an opposite end movable between respective control positions of engagement and disengagement with the fixed contact in response to temperature change, the thermostat metal element having an indenture with a convex side movable from an original dished configuration to an inverted dished configuration with snap action as the element moves from a control position of contact engagement to a control position of contact disengagement, characterized in that pushbutton means are mounted on the frame for manual movement against the side of the indenture which is convex when the thermostat metal element is in said control position of contact disengagement to press the indenture to return its original dished configuration for resetting the device while also assuring that the element is held in said control position of contact disengagement by the pushbutton means until manual movement of the pushbutton means is released.

17. A thermally responsive device according to claim 16 wherein the thermostat metal element is adapted to move from said original dished configuration to said inverted dished configuration at a selected operating temperature and normally adapted to return to its original dished configuration only at a relatively much lower reset temperature so that movement of the pushbutton means is normally required for resetting the device.

18. A thermally responsive device comprising a frame, a fixed contact on the frame, and a thermostat metal element having one end fastened to the frame and an opposite end movable between respective control positions of engagement and disengagement with the fixed contact in response to temperature change the frame comprising two parallel metal carriers respectively mounting the fixed contact and the thermostat element and having a pair of ceramic pins extending in parallel relation to each other through holes in the respective carriers for securing the carriers in selected, spaced, electrically insulated parallel relation to each other on the pins, the thermostat metal element having an indenture with a convex side movable from an original dished configuration to an inverted dished configuration with snap action as the element moves from a control position of contact engagement to a control position of contact disengagement, and the pushbutton means being mounted on one of the carriers for manual movement against the side of the indenture which is convex when the thermostat metal element is in said control position of contact disengagement for pressing the indenture to return to its original dished configuration for resetting the device while also assuring that the element is pressed toward the carrier mounting the element to be held in said control position of contact disengagement by the pushbutton means until manual movement of the pushbutton means is released.

* * * * *